US007157645B2

(12) United States Patent
Huffman

(10) Patent No.: US 7,157,645 B2
(45) Date of Patent: Jan. 2, 2007

(54) COAXIAL CABLES HAVING IMPROVED SMOKE PERFORMANCE

(75) Inventor: Jason Huffman, Denver, NC (US)

(73) Assignee: CommScope Properties, LLC, Sparks, NV (US)

( * ) Notice: Subject to any disclaimer, the term of this patent is extended or adjusted under 35 U.S.C. 154(b) by 0 days.

(21) Appl. No.: 11/051,256

(22) Filed: Feb. 4, 2005

(65) Prior Publication Data

US 2006/0175074 A1 Aug. 10, 2006

(51) Int. Cl.
*H01B 7/18* (2006.01)

(52) U.S. Cl. ..... 174/120 R; 174/106 R

(58) Field of Classification Search ..... 174/102 R, 174/106 R, 102 SP
See application file for complete search history.

(56) References Cited

U.S. PATENT DOCUMENTS

| | | | | |
|---|---|---|---|---|
| 4,088,830 | A | 5/1978 | Wargin et al. | |
| 4,472,598 | A | 9/1984 | Boyd et al. | |
| 4,647,712 | A | 3/1987 | Alloin et al. | |
| 4,800,351 | A | 1/1989 | Rampalli et al. | |
| 5,902,962 | A | 5/1999 | Gazdzinski | |
| 5,926,949 | A | 7/1999 | Moe et al. | |
| 5,949,018 | A * | 9/1999 | Esker | 174/23 R |
| 5,959,245 | A | 9/1999 | Moe et al. | |
| 6,130,385 | A | 10/2000 | Tuunanen et al. | |
| 6,137,058 | A | 10/2000 | Moe et al. | |
| 6,326,551 | B1 | 12/2001 | Adams | |
| 6,355,879 | B1 | 3/2002 | Bertini et al. | |
| 6,448,501 | B1 | 9/2002 | McIntyre et al. | |
| 6,596,393 | B1 * | 7/2003 | Houston et al. | 428/389 |
| 6,610,931 | B1 * | 8/2003 | Perelman et al. | 174/102 R |
| 6,800,809 | B1 | 10/2004 | Moe et al. | |

FOREIGN PATENT DOCUMENTS

| | | | |
|---|---|---|---|
| JP | 9-167528 | * | 6/1997 |
| JP | 9-185913 | * | 7/1997 |

* cited by examiner

*Primary Examiner*—Chau Nguyen N.
(74) *Attorney, Agent, or Firm*—Myers Bigel Sibley & Sajovec, P.A.

(57) ABSTRACT

A coaxial cable includes an elongate inner conductor. A dielectric layer surrounds the inner conductor. A first outer conductor surrounds the dielectric layer and has perforations defined therein. A second outer conductor surrounds the first outer conductor. A polymeric jacket surrounds the second outer conductor. The cable is adapted such that, when the dielectric layer is melted, at least a portion thereof and/or smoke therefrom can flow through the perforations in the first outer conductor. According to some embodiments, the second outer conductor defines a plurality of voids therein and, when the dielectric layer is melted, at least a portion thereof and/or smoke therefrom can flow through the perforations in the first outer conductor and into the voids. According to some embodiments, the second outer conductor is braided.

31 Claims, 3 Drawing Sheets

COAXIAL CABLES HAVING IMPROVED SMOKE PERFORMANCE

FIELD OF THE INVENTION

The present invention relates to coaxial cables and, more particularly, to coaxial cables having improved smoke performance.

BACKGROUND OF THE INVENTION

Coaxial cables are commonly employed as plenum cables. A plenum cable is a cable that is run in the plenum space of a building. The plenum space is a space that is used for air circulation in heating and air conditioning systems, for example, and is typically located between a structural ceiling and a suspended ceiling or under a raised floor. Plenum cables may be used for transmitting video, telephone, and/or data signals through a building, for example. Plenum areas may present a particular hazard in the event of a fire because there are few barriers to contain flame and smoke within the plenum. Therefore, plenum cables may be subject to safety standards such as National Fire Protection Agency NFPA 262 Standard Method for Flame Travel and Smoke of Wires and Cables for Use in Air Handling Spaces (2002) (hereinafter "NFPA 262 (2002)").

SUMMARY OF THE INVENTION

According to embodiments of the present invention, a coaxial cable includes an elongate inner conductor. A dielectric layer surrounds the inner conductor. A first outer conductor surrounds the dielectric layer and has perforations defined therein. A second outer conductor surrounds the first outer conductor. A polymeric jacket surrounds the second outer conductor. The cable is adapted such that, when the dielectric layer is melted, at least a portion thereof and/or smoke therefrom can flow through the perforations in the first outer conductor. According to some embodiments, the second outer conductor defines a plurality of voids therein and, when the dielectric layer is melted, at least a portion thereof and/or smoke therefrom can flow through the perforations in the first outer conductor and into the voids. According to some embodiments, the second outer conductor is braided.

According to further embodiments of the present invention, a coaxial cable includes an elongate inner conductor. A dielectric layer surrounds the inner conductor. An outer conductor surrounds the dielectric layer and has perforations defined therein. A polymeric jacket surrounds the second outer conductor. The perforations in the outer conductor each have an area of between about 0.001 and 0.020 $in^2$. The cable is adapted such that, when the dielectric layer is melted, at least a portion thereof and/or smoke therefrom can flow through the perforations in the outer conductor.

According to further embodiments of the present invention, a coaxial cable includes an elongate inner conductor. A dielectric layer surrounds the inner conductor. An outer conductor surrounds the dielectric layer and has perforations defined therein. A polymeric jacket surrounds the second outer conductor. The cable is adapted to pass NFPA 262 (2002). The cable is adapted such that the shielding effectiveness of the cable, as measured in accordance with EN 50289-1-6: 2002, is not degraded by more than about 7 dB as compared to the same cable not having the perforations. The cable is adapted such that, when the dielectric layer is melted, at least a portion thereof and/or smoke therefrom can flow through the perforations in the outer conductor.

Further features, advantages and details of the present invention will be appreciated by those of ordinary skill in the art from a reading of the figures and the detailed description of the embodiments that follow, such description being merely illustrative of the present invention.

DETAILED DESCRIPTION OF EMBODIMENTS OF THE INVENTION

Figure 1:
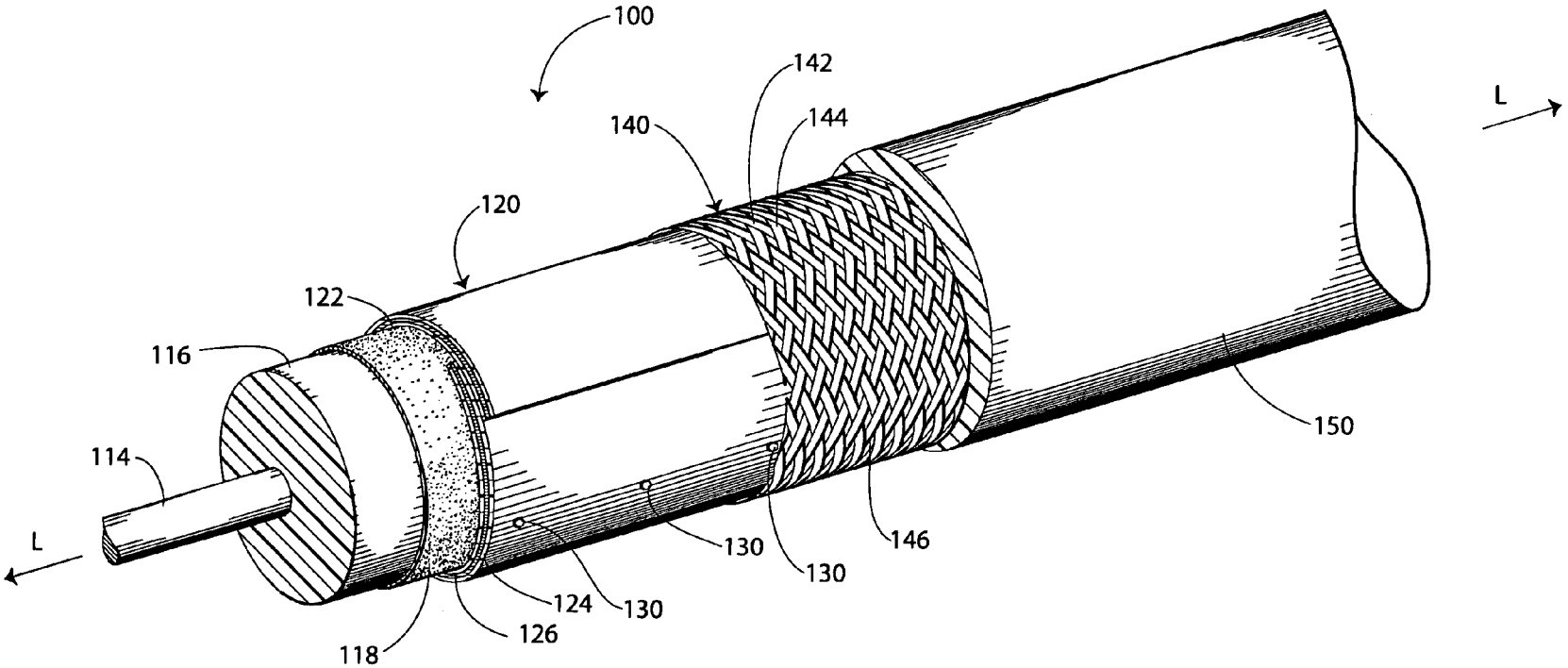
FIG. 1 is a cut-away perspective view of a coaxial cable in accordance with embodiments of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled"

with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a "first" element, component, region, layer or section discussed below could also be termed a "second" element, component, region, layer or section without departing from the teachings of the present invention. The sequence of operations (or steps) is not limited to the order presented in the claims or figures unless specifically indicated otherwise.

With reference to FIG. 1, a coaxial cable 100 according to embodiments of the present invention is shown therein. The cable 100 includes generally an electrically conductive elongate center or inner conductor 114, an insulation or dielectric layer 116, an adhesive layer 118, an electrically conductive first outer shield or conductor 120, an electrically conductive second outer shield or conductor 140, and an outer jacket 150. According to some embodiments and as illustrated, the foregoing components are substantially concentrically positioned about and extend along a lengthwise axis L—L. These components will be described in more detail below.

As discussed in more detail below, the outer conductor 120 includes perforations 130 defined therein that serve to advantageously manage the flow of the material of the dielectric layer 116 and/or the flow of smoke therefrom upon melting of the dielectric layer 116 such that the generation of smoke from the cable 100 may be reduced and/or controlled. The improved burn performance provided by the cable construction of the present invention may allow the use of less expensive materials for the jacket while maintaining satisfactory burn performance/smoke levels.

The inner conductor 114 is typically formed of solid wire. It can be formed of any material that can conduct an electrical signal, but is preferably formed of solid copper, copper clad aluminum (CCA), silver coated copper or copper clad steel (CCS), with any of these materials being optionally plated with tin, silver or gold. Such plating can reduce the resistance of the inner conductor 114. In some embodiments, tempering of the copper, aluminum or steel under specific conditions during their formation can be carried out to enhance performance and/or impact conductivity. Also, when copper is employed as either the core material or as a cladding material, it may be preferred to use so-called "oxygen-free" copper, which is a commercially pure, high conductivity copper that has been produced in such a manner that it contains virtually no oxides or residual deoxidants. According to some embodiments, the conductor 114 has a diameter of between about 0.015 and 0.065 inch.

The dielectric layer 116 circumferentially surrounds the inner conductor 114. The dielectric layer 116 may be formed of any suitable polymeric material. According to some embodiments, the dielectric layer 116 is formed of a foamed fluorinated ethylene propylene (FEP). According to some embodiments, the thickness of the dielectric layer 116 is between about 0.025 and 0.115 inch.

The first outer conductor 120 circumferentially surrounds the dielectric layer 116. According to some embodiments, and as shown, the outer conductor 120 is a laminated shielding tape that is applied such that the edges of the tape are either in abutting relationship or overlapping (as shown) to provide 100% shielding coverage. The outer conductor 120 as illustrated includes a pair of thin metallic foil layers 122 and 124 that are bonded to opposite sides of a polymeric layer 126. According to some embodiments, the polymeric layer 126 is a polyolefin (e.g., polypropylene) film or a polyester film. The metal layers 122, 124 may be aluminum foil layers (including aluminum alloys). Other suitable materials and/or more or fewer layers may be used to form the outer conductor 120.

As shown, the outer conductor 120 may be bonded to the dielectric layer 116 by a thin adhesive layer 118. Suitable adhesives for the adhesive layer 118 include low-density polyethylene, ethylene vinyl acetate (EVA), ethylene acrylic acid (EAA), and ethylene methylacrylate (EMA), and mixtures and formulations thereof. According to some embodiments and as shown, the outer conductor 120 is secured directly to the outer surface of the dielectric layer 116 by the adhesive layer 118.

According to some embodiments, the outer conductor 120 has a total thickness (i.e., including the polymer layer 126 and all of the metallic foil layers 122, 124) of between about 0.001 and 0.005 mil. According to some embodiments, the metallic foil layers 122, 124 have a combined thickness of between about 0.00035 and 0.002 mil. The two metallic layers 122, 124 may be replaced with a single metallic layer having a thickness in the same range.

A plurality of perforations 130 are defined in and extend radially fully through the outer conductor 120. The perforations 130 may be distributed randomly or according to a prescribed pattern. According to some embodiments and as shown in FIG. 1, the perforations 130 are generally circular.

According to some embodiments, the collective area of the perforations 130 is no more than 2% of the total area of the outer conductor 120 (i.e., 2% of the outer conductor 120 is perforated). According to some embodiments, each of the perforations 130 has an area of between about 0.001 and 0.020 $in^2$. According to some embodiments, the area of each perforation 130 is between about 0.006 and 0.012 $in^2$. According to some embodiments, the perforations are distributed along the conductor 120 at a rate in the range of from about one perforation per 0.25 inch length of the cable 100 to about one perforation per 3 inches length of the cable, and, according to some embodiments, in the range of from about one perforation per 0.75 inch length of the cable to about one perforation per 1.25 inches length of the cable. According to some embodiments, the nominal distance separating adjacent ones of the perforations 130 is between about 0.25 and 3 inches. According to some embodiments, the nominal distance separating adjacent ones of perforations 130 is between about 0.75 and 1.25 inches. In the drawings, for clarity, the relative sizing and spacing of the perforations 130 may not be to scale.

The second outer conductor 140 circumferentially surrounds the outer conductor 120. According to some embodiments and as illustrated, the outer conductor 140 is a braided shield or sheath formed by interlacing a plurality of conductive wires 142 with a plurality of wires 144 so as to form a braided tubular web defining a plurality of voids 146 between the wires 142, 144. According to some embodiments, the voids 146 take the form of radially-extending through holes as shown in FIG. 1. The wires 142, 144 may be formed of any suitable metal. According to some embodiments, the wires 142, 144 are formed of tinned copper. Other suitable materials for the wires 142, 144 include bare copper and aluminum.

According to some embodiments, the outer conductor 140 covers at least about 50% of the outer conductor 120, and according to more particular embodiments, between about 50 and 98%.

The jacket 150 circumferentially surrounds the outer conductor 140 and is typically formed of a polymeric material, which may be the same as or different from that of the dielectric layer 116. Exemplary materials include polyvinyl chloride (PVC), fluoropolymers, and co-polymers and blends thereof. According to some embodiments, PVC is preferred. The jacket 150 should be formed of a material that can protect the internal components from external elements (such as water, dirt, dust and fire) and from physical abuse. The material of the jacket 150 may include additives, such as carbon black, to enhance UV resistance. According to some embodiments, the jacket 150 has a thickness of between about 0.013 and 0.030 inch. In some embodiments, the jacket 150 is bonded to the outer conductor 140 with an adhesive, (not shown); exemplary adhesives are as described above. Typically, however, the jacket 150 is not bonded to the outer conductor 140.

In use, a conventional coaxial cable may be subjected to fire or extreme heat, causing the dielectric layer thereof to melt. The multilayer dielectric material and/or smoke may run down the length of cable and erupt or escape through an end opening of the jacket and pool on a surface. The pooled molten dielectric polymer may then tend to generate smoke as a result of residual heat and/or continuing exposure to heat or fire. Such smoke may present various hazards, including toxicity.

By contrast, when the cable 100 of the present invention is exposed to fire or extreme heat that causes the dielectric layer 116 to melt, a portion or all of the molten dielectric polymer and/or smoke or other gas therefrom will flow or seep radially outwardly through the perforations 130 in the first outer conductor 120 and into the space or volume between the first outer conductor 120 and the jacket 150. More particularly, the molten dielectric material and/or smoke will flow or seep into the voids 146 defined in the braided outer conductor 140 and/or voids defined between the outer conductor 120 and the outer conductor 140 and/or the outer conductor 140 and the jacket 150. The outer conductor 120, the braided outer conductor 140 and the jacket 150 may thereby provide chambers for "capture" or collection of the molten dielectric material or smoke and/or baffling to inhibit the flow of the dielectric material or smoke along the length of the cable 100. In some cases, the jacket 150 may deteriorate (e.g., burn off), crack, etc., allowing portions of the molten material and/or smoke to further seep through the jacket in a more distributed and gradual manner. It will be appreciated that in the cable 100 the molten dielectric material is better retained in or released through the jacket 150, thereby inhibiting the generation of smoke from the molten dielectric material and/or providing a more controlled release of material or smoke.

Figure 2:
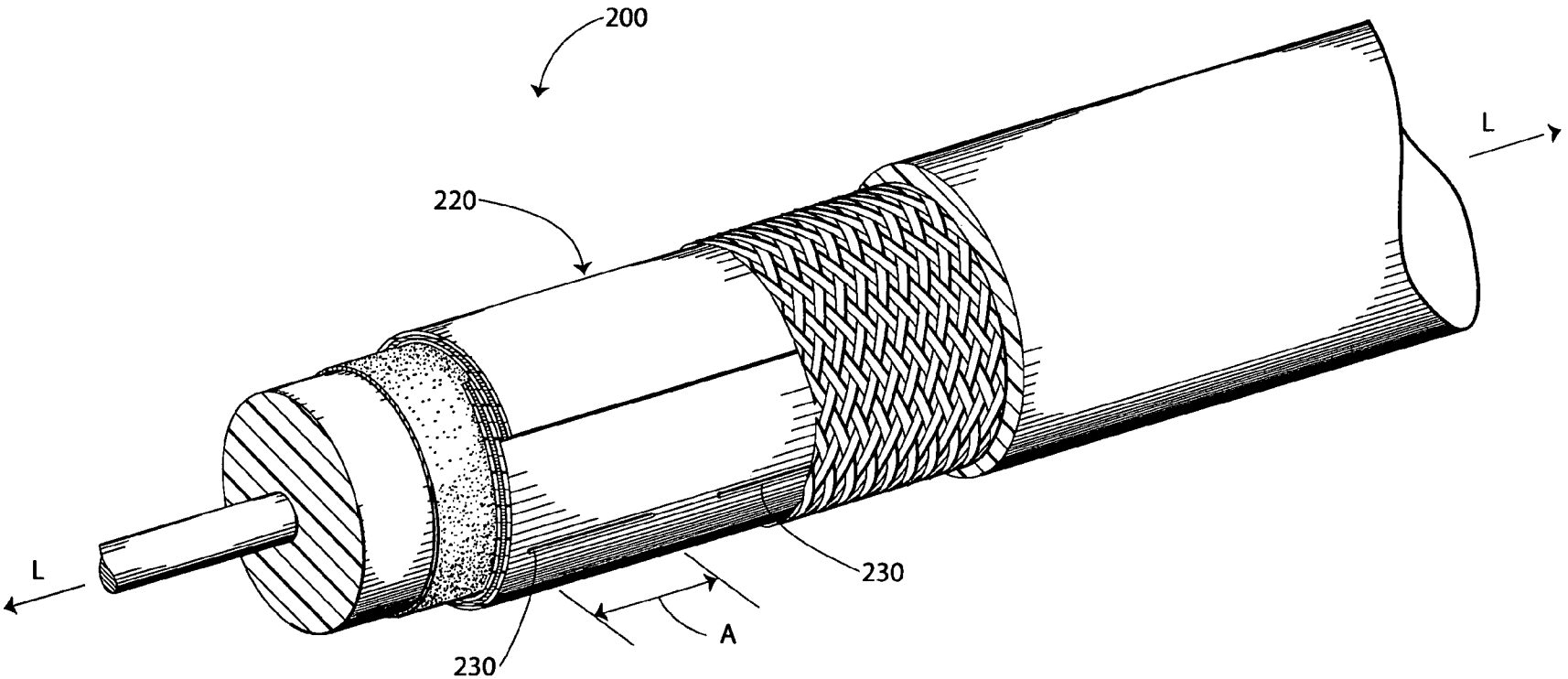
FIG. 2 is a cut-away perspective view of a coaxial cable in accordance with further embodiments of the present invention.

With reference to FIG. 2, a coaxial cable 200 according to further embodiments of the present invention is shown therein. The cable 200 is constructed in the same manner as the cable 100 except that the generally circular perforations 130 are replaced with longitudinally extending slits 232.

According to some embodiments, the slits 232 have a length A extending along the cable axis L—L of at least about 0.05 inch. According to some embodiments, the length A is at least about five times the width of the slit. The slits 232 preferably extend fully radially through the outer conductor 220. The slits 232 may have the same relative and absolute area dimensions as described above with respect to the outer conductor 120 and the circular perforations 130.

Figure 3:
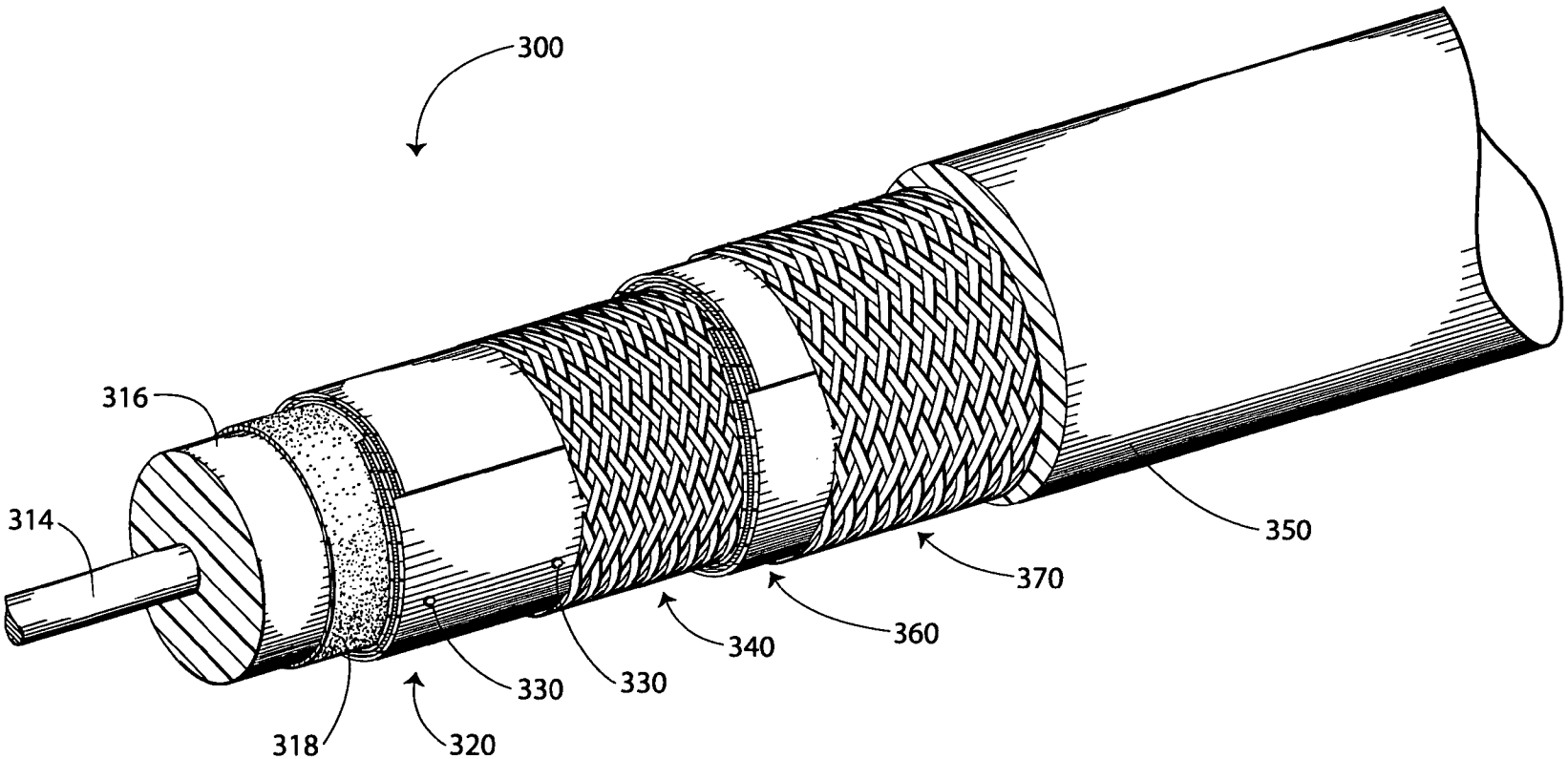
FIG. 3 is a cut-away perspective view of a coaxial cable in accordance with further embodiments of the present invention.

With reference to FIG. 3, a coaxial cable 300 according to further embodiments of the present invention is shown therein. The cable 300 includes an inner conductor 314, a dielectric layer 316, an adhesive layer 318, a first outer conductor 320 with perforations 330, a second outer conductor 340, and a jacket 350 corresponding to and constructed in the same manner as the inner conductor 114, the dielectric layer 116, the adhesive layer 118, the outer conductor 120, the perforations 130, the outer conductor 340, and the jacket 350, respectively, of the coaxial cable 100. The cable 300 differs from the cable 100 by the further provision of a third outer conductor 360 that circumferentially surrounds the outer conductor 340, and a fourth outer conductor 370 that circumferentially surrounds the outer conductor 360.

The outer conductor 360 may be constructed in the same manner as described above for the outer conductor 120. However, according to some embodiments and as shown, the outer conductor 360 preferably does not include perforations corresponding to the perforations 130 or 330. The outer conductor 360 preferably is not adhered to the outer conductor 340. The outer conductor 370 may be constructed in the same manner as described above with regard to the conductor 140. The cable 300 may be referred to as a "quad-shielded" coaxial cable.

It will be appreciated that cables of the present invention may be particularly well suited for use as plenum cables. According to some embodiments, cables in accordance with the present invention (e.g., the cables 100, 200, 300) are adapted to satisfactorily meet and pass NFPA 262 (2002). According to some embodiments, the cables are adapted to comply with NFPA 262 (2002) and have jackets that are formed of PVC. By employing the construction of the cable with perforations as described herein, PVC may be used for the jacket material while nonetheless complying with the applicable burn/smoke safety standard(s) where a conventional cable of similar construction formed without the inventive perforations would fail to comply.

Certain cables according to the present invention are adapted to provide a desired level of burn performance suitable for use as plenum cable without the inner conductor perforations thereof significantly degrading the shielding effectiveness of the cable as compared to the same cable not having the perforations. According to some embodiments, cables in accordance with the present invention are adapted to satisfactorily meet and pass NFPA 262 (2002) and are further adapted such that the shielding effectiveness of the cable, as measured in accordance with CENELEC Shielding Test EN 50289-1-6 Triax Method, Communications Cables—Specification for Test Methods Part 1–6: 2002 (Electrical Test Methods—Electro-Magnetic Performance) (hereinafter "EN 50289-1-6: 2002"), is not degraded by more than about 7 dB as compared to the same cable without the perforations, and, according to some embodiments, is not degraded by more than about 2 dB.

Although the second outer conductor 140 (or 340) has been described hereinabove as a braided outer conductor, the outer conductor 140 may be replaced with outer shields having other configurations. For example, the second outer conductor (e.g., the outer conductor 140 or the outer conductor 340) may be replaced with one or more tapes or layers having dimples or baffles that define voids or the like, and the voids may or may not extend fully radially through the outer conductor. As a further alternative, the second outer conductor may take the form of a plurality of elongate wires that are helically wound about the outer conductor 120, 220, 320. An additional set of elongate wires may be counterwound around the first set of wound wires.

According to some embodiments, the second outer conductor (e.g., the outer conductor 140 or 340) may be omitted.

The slits 232 may be modified to run circumferentially or both circumferentially or longitudinally (i.e., helically or obliquely). Cables according to the present invention may include a combination of circular perforations and slits in the outer conductor adjacent the dielectric layer. Perforations having other geometric shapes may also be used.

Cables as described herein may be formed in the same manner as known cables of similar construction with the exception that the outer conductor surrounding and adjacent the dielectric layer is perforated before or after mounting on the dielectric layer. Methods for forming cables according to the present invention will be readily apparent to those skilled in the art upon reading the description herein.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

The invention claimed is:

1. A coaxial cable comprising:

a) an elongate inner conductor;

b) a dielectric layer surrounding the inner conductor;

c) a first outer conductor surrounding the dielectric layer and having perforations defined therein;

d) a second outer conductor surrounding the first outer conductor; and e) a polymeric jacket surrounding the second outer conductor;

f) wherein the cable is configured such that, when the dielectric layer is melted, at least a portion thereof and/or smoke therefrom can flow through the perforations in the first outer conductor; and e) wherein the first outer conductor has a thickness of between about 0.001 and 0.005 mil.

2. The coaxial cable of claim 1 wherein the second outer conductor defines a plurality of voids and, when the dielectric layer is melted, at least a portion thereof and/or smoke therefrom can flow through the perforations in the first outer conductor and into the voids.

3. The coaxial cable of claim 2 wherein the second outer conductor is braided.

4. The coaxial cable of claim 2 wherein the second outer conductor covers between about 50 and 98% of the first outer conductor.

5. The coaxial cable of claim 1 wherein the cable is configured to pass NFPA 262 (2002).

6. The coaxial cable of claim 5 wherein the cable is configured such that the shielding effectiveness of the cable, as measured in accordance with EN 50289-1-6: 2002, is not degraded by more than about 7 dB as compared to the same cable not having the perforations.

7. The coaxial cable of claim 5 wherein the jacket is formed of polyvinyl chloride (PVC).

8. The coaxial cable of claim 5 wherein the cable is configured for use as a plenum cable.

9. The coaxial cable of claim 1 wherein the perforations in the first outer conductor are generally circular holes.

10. The coaxial cable of claim 1 wherein the perforations in the first outer conductor are slits.

11. The coaxial cable of claim 1 wherein the inner conductor is formed of a material selected from the group consisting of solid copper, copper clad aluminum (CCA), silver coated copper, and copper clad steel (CCS).

12. The coaxial cable of claim 1 wherein the dielectric layer is formed of a foamed polymeric material.

13. The coaxial cable of claim 12 wherein the dielectric layer is formed of foamed fluorinated ethylene propylene (FEP).

14. The coaxial cable of claim 1 wherein the first outer conductor is a metallic tape.

15. The coaxial cable of claim 14 wherein the first outer conductor includes a metallic layer laminated to a polymer layer.

16. The coaxial cable of claim 1 wherein the second outer conductor is formed of a material selected from the group consisting of tinned copper, bare copper, and aluminum.

17. The coaxial cable of claim 1 wherein the jacket is formed of a material selected from the group consisting of polyvinyl chloride (PVC), a fluoropolymer, and co-polymers and blends thereof.

18. The coaxial cable of claim 1 further including a third outer conductor surrounding the second outer conductor and surrounded by the jacket.

19. The coaxial cable of claim 18 wherein the third outer conductor is a metallic tape.

20. The coaxial cable of claim 19 further including a fourth outer conductor surrounding the third outer conductor and surrounded by the jacket.

21. The coaxial cable of claim 20 wherein the fourth outer conductor is braided.

22. A coaxial cable comprising:

a) an elongate inner conductor;

b) a dielectric layer surrounding the inner conductor;

c) an outer conductor surrounding the dielectric layer and having perforations defined therein;

d) a polymeric jacket surrounding the outer conductor;

e) wherein the perforations in the outer conductor each have an area of between about 0.001 and 0.020 $in^2$; and f) wherein the cable is adapted such that, when the dielectric layer is melted, at least a portion thereof and/or smoke therefrom can flow through the perforations in the outer conductor.

23. The coaxial cable of claim 22 further including a second outer conductor surrounding the first outer conductor, wherein the second outer conductor defines a plurality of voids and, when the dielectric layer is melted, at least a portion thereof and/or smoke therefrom can flow through the perforations in the first outer conductor and into the voids.

24. The coaxial cable of claim 23 wherein the second outer conductor is braided.

25. The coaxial cable of claim 22 further including a second outer conductor surrounding the first outer conductor.

26. A coaxial cable comprising:

a) an elongate inner conductor;

b) a dielectric layer surrounding the inner conductor;

c) an outer conductor surrounding the dielectric layer and having perforations defined therein;

d) a polymeric jacket surrounding the outer conductor;

e) wherein the cable is configured to pass NFPA 262 (2002);

f) wherein the cable is configured such that the shielding effectiveness of the cable, as measured in accordance with EN 50289-1-6: 2002, is not degraded by more than about 7 dB as compared to the same cable not having the perforations;

g) wherein the cable is configured such that, when the dielectric layer is melted, at least a portion thereof and/or smoke therefrom can flow through the perforations in the outer conductor; and h) wherein the outer conductor has a thickness of between about 0.001 and 0.005 mil.

27. The coaxial cable of claim 26 further including a second outer conductor surrounding the first outer conductor, wherein the second outer conductor defines a plurality of voids and, when the dielectric layer is melted, at least a portion thereof and/or smoke therefrom can flow through the perforations in the first outer conductor and into the voids.

28. The coaxial cable of claim 27 wherein the second outer conductor is braided.

29. A coaxial cable comprising:

a) an elongate inner conductor;

b) a dielectric layer surrounding the inner conductor;

c) a first outer conductor surrounding the dielectric layer and having perforations defined therein;

d) a second outer conductor surrounding the first outer conductor; and e) a polymeric jacket surrounding the second outer conductor;

f) wherein the cable is adapted such that, when the dielectric layer is melted, at least a portion thereof and/or smoke therefrom can flow through the perforations in the first outer conductor; and g) wherein the collective area of the perforations is no more than 2% of the total area of the first outer conductor.

30. A coaxial cable comprising:

a) an elongate inner conductor;

b) a dielectric layer surrounding the inner conductor;

c) a first outer conductor surrounding the dielectric layer and having perforations defined therein;

d) a second outer conductor surrounding the first outer conductor; and e) a polymeric jacket surrounding the second outer conductor;

f) wherein the cable is adapted such that, when the dielectric layer is melted, at least a portion thereof and/or smoke therefrom can flow through the perforations in the first outer conductor; and g) wherein the perforations in the first outer conductor are distributed along the first outer conductor at a rate in the range of from about one perforation per 0.25 inch length of the cable to about one perforation per 3 inches length of the cable.

31. A coaxial cable comprising:

a) an elongate inner conductor;

b) a dielectric layer surrounding the inner conductor;

c) a first outer conductor surrounding the dielectric layer and having perforations defined therein;

d) a second outer conductor surrounding the first outer conductor; and e) a polymeric jacket surrounding the second outer conductor;

f) wherein the cable is adapted such that, when the dielectric layer is melted, at least a portion thereof and/or smoke therefrom can flow through the perforations in the first outer conductor; and g) wherein the perforations in the first outer conductor have a nominal separation distance of between about 0.75 and 1.25 inches.

* * * * *